United States Patent [19]

Trump et al.

[11] Patent Number: 5,050,753

[45] Date of Patent: Sep. 24, 1991

[54] PREFERENTIALLY STRENGTHENED TAMPER-INDICATING PLASTIC CLOSURE

[75] Inventors: Hubert D. Trump, Crawfordsville; Stephen W. McBride, Brownsburg; Lawrence M. Smeyak, Lafayette, all of Ind.

[73] Assignee: H-C Industries, Inc., Crawfordsville, Ind.

[21] Appl. No.: 572,249

[22] Filed: Aug. 27, 1990

[51] Int. Cl.[5] ..... B65D 41/34

[52] U.S. Cl. ..... 215/252; 215/253

[58] Field of Search ..... 215/252, 253, 256, 258; 220/265, 266

[56] References Cited

U.S. PATENT DOCUMENTS 4,418,828 12/1983 Wilde et al. .
4,458,821 7/1984 Ostrowsky ..... 215/252
4,497,765 2/1985 Wilde et al. .
4,550,843 11/1985 Nolan .
4,635,808 1/1987 Nolan .
4,770,306 9/1988 Szczesniak ..... 215/252
4,923,073 5/1990 Wilde .
4,938,370 7/1990 McBride .
5,305,516 12/1981 Perne et al. .

*Primary Examiner*—Stephen Marcus
*Assistant Examiner*—Paul Schwarz

[57] ABSTRACT

A tamper-indicating plastic closure includes a pilfer band at least partially detachably connected to a skirt portion of the closure by a frangible connection. The frangible connection comprises a plurality of circumferentially spaced frangible bridges, which fracture attendant to removal of the closure from an associated container to provide visually discernable evidence of opening. In order to facilitate high-speed application of the closure to a container, one or more regions of the frangible connection are preferentially strengthened by the provision of relatively strengthened frangible bridges. At least one of the strengthened bridges is generally diametrically opposed to the leading portion of the internal thread formation of the closure.

16 Claims, 2 Drawing Sheets

PREFERENTIALLY STRENGTHENED TAMPER-INDICATING PLASTIC CLOSURE

TECHNICAL FIELD

The present invention relates generally to tamper-indicating plastic closures for containers, and more particularly to a tamper-indicating closure having a preferentially strengthened frangible connection between a skirt portion of the closure and the closure pilfer band to facilitate high-speed closure application while resisting premature detachment of the pilfer band.

BACKGROUND OF THE INVENTION

Commonly-assigned U.S. Pat. No. 4,938,370, issued July 3, 1990, and U.S. patent application Ser. No. 465,301, filed Jan. 23, 1990, illustrate various embodiments of a tamper-indicating plastic closure which has proven highly resistent to tampering or the like, and which is configured to facilitate economical, high-speed manufacture. Notably, this type of tamper-indicating closure is configured to provide two modes of tamper-indication for enhanced effectiveness.

In a first mode of operation, inwardly extending flexible tabs of the closure pilfer band are arranged to extend angularly upwardly into contact with the annular, locking portion of a container. During closure removal, this arrangement effects at least partial, readily visually discernable detachment of the pilfer band from a skirt portion of the closure by fracture of a frangible connection therebetween. In a second mode of operation, the flexible tabs are positionable to extend angularly downwardly, and thereby cooperate with an annular interference bead of the pilfer band to decrease the effective internal diameter of the pilfer band. Again, this effects the desired fracture of the frangible connection attendant to closure removal from the container.

In accordance with the above disclosures, a frangible connection between the pilfer band and the skirt portion of the closure is preferably provided by a plurality of circumferentially spaced, frangible bridges which extend between the inside surfaces of the skirt portion and the pilfer band. A circumferentially extending score line distinguishes the pilfer band from the skirt portion, with the score line extending partially into the frangible bridges. This type of frangible construction is illustrated in commonly-assigned U.S. Pat. No. 4,418,828.

As will be appreciated, in order to provide the desired tamper-indicating function, a closure of the present type must be manufactured so that the frangible connection between the pilfer band and the skirt portion does not fail or fracture during high-speed application of the closure to the container. Thereafter, the closure should consistently and reliably fracture at the frangible connection attendant to partial or complete closure removal. The present invention has been found to desirably abate premature detachment of the closure pilfer band by fracture of the frangible connection during automatic high-speed application of closures to containers.

SUMMARY OF THE INVENTION

In accordance with the present invention, a tamper-indicating plastic closure includes a frangible connection between a skirt portion of the closure and the container-engaging closure pilfer band positioned therebeneath. In order to abate premature detachment of the pilfer band by fracture of the frangible connection during high-speed application of the closure to a container, the frangible connection between the pilfer band and the skirt portion is preferentially strengthened in those areas which have proven subject to premature fracture. Notably, the preferential strengthening has proven most effective when circumferentially spaced from the leading portion of an internal thread formation of the closure.

In accordance with the illustrated embodiment; 10 the present tamper-indicating closure includes a generally cup-shaped plastic closure cap having a circular top wall portion, and a depending, annular skirt portion. The skirt portion includes a helical, internal thread formation, which cooperates with a like thread formation on the associated container for removably retaining the closure in position thereon.

As will be appreciated, the thread formation includes a leading portion which first engages a container during application of the closure thereto. This leading portion, which comprises between about 90° to 180° of the extent of the thread formation, substantially provides the downward driving force on the closure during application. In the illustrated embodiment, the thread formation extends about 540° circumferentially of the skirt portion of the closure. Thus, a region of the skirt portion extending about 180° has a single thread profile, and a diametrically opposed region (also extending about 180°) has a double thread profile, i.e., about one-half of the skirt portion has a double thread, and about one-half has a single thread. Accordingly, the leading portion of the thread formation in the illustrated embodiment generally extends along the double thread profile region of the skirt portion.

The present closure further includes a tamper-indicating pilfer band positioned beneath the skirt portion of the closure, with the pilfer band including an arrangement for engaging the container for tamper-indication. In the illustrated embodiment, this arrangement comprises a plurality of inwardly extending flexible tabs which are configured, in a first mode of operation, to interferingly engage an annular, locking ring portion of the container. The pilfer band further includes an annular interference bead, with the flexible tabs being further configured to cooperate with the interference bead for reducing the effective inside diameter of the pilfer band, thereby providing a second mode of tamper-indication. As will be appreciated, the present invention can be employed on tamper-indicating closures having other tamper-indicating constructions.

In accordance with the present invention, a preferentially strengthened frangible connection is provided for at least partially detachably connecting the pilfer band to the skirt portion of the closure. The frangible connection comprises a plurality of circumferentially spaced frangible bridges, which in the illustrated embodiment, extend between the inside surfaces of the skirt portion of the closure and the pilfer band. A score line extends circumferentially of the closure, and separates and distinguishes the pilfer band from the skirt portion, with the score line extending partially into the frangible bridges such that the unscored, residual portions of the bridges provide the desired frangible connection.

While all of the bridges are intended to be frangible, and thus fracture attendant to closure removal from the container, the present invention contemplates that at least one, and preferably a plurality, of the frangible bridges are relatively strengthened for resisting premature detachment of the pilfer band from the skirt portion. The present invention contemplates that the relatively strengthened frangible bridges be spaced from the leading portion of the closure thread formation, with at least one relatively strengthened frangible bridge being generally diametrically opposed to the center of the leading portion of the thread formation. In the illustrated embodiment, a pair of relatively strengthened frangible bridges are provided which are generally diametrically opposed to the region of the skirt portion having the double thread profile, i.e., the region which carries the leading portion of the thread formation.

It is presently preferred that a plurality of relatively strengthened frangible bridges be provided, with at least two of the strengthened bridges having differing cross-sectional areas to provide differing strengths. Testing during development of the present invention indicated that undesirable premature detachment of the pilfer band, attendant to high-speed closure application, exhibited varying severity in different regions of the frangible connection.

Thus, it is presently preferred that at least one of the strengthened frangible bridges comprise a primary strengthening bridge having a first relatively large cross-sectional area, with this primary strengthening bridge being generally diametrically opposed to the leading portion of the thread formation. Further, at least one of the strengthened bridges comprises a secondary strengthening bridge having a second cross-sectional area less than the first area. This secondary strengthening bridge is preferably circumferentially spaced from between about 45° to 90° from the primary strengthening bridge. In the illustrated embodiment, a pair of primary strengthening bridges are provided diametrically opposed to the leading portion of the thread formation, with two pairs of secondary strengthening bridges provided, with each pair of the secondary bridges spaced between about 45° to 90° from the pair of primary strengthening bridges.

Other features and advantages of the present invention will become readily apparent from the following detailed description, the accompanying drawings, and the appended claims.

DETAILED DESCRIPTION

Figure 1:
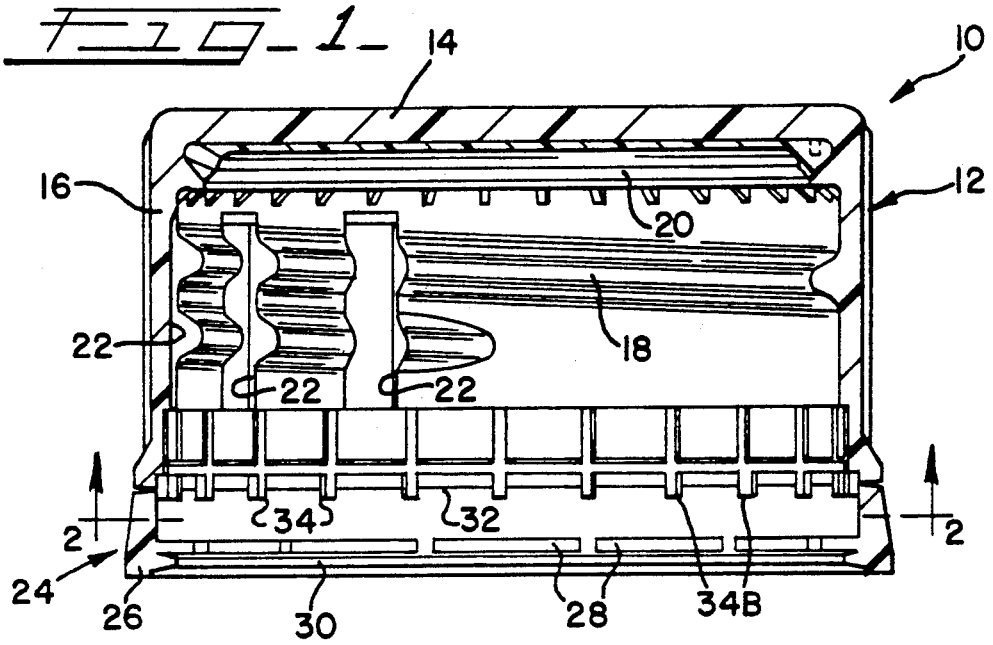
FIG. 1 is a cross-sectional view of a tamper-indicating plastic closure embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference now to the drawings, therein is illustrated a tamper-indicating plastic closure 10 embodying the principles of the present invention. The closure 10 includes a generally cup-shaped closure cap 12 having a circular top wall portion 14, and a depending annular skirt portion 16. The skirt portion 16 includes an internal thread formation 18 configured for cooperation with a like thread formation on an associated container C to which the closure is fitted.

In a presently preferred form, the thread formation 18 of the closure extends more than 360° circumferentially of the skirt portion of the closure, with the thread formation in the illustrated embodiment extending about 540°. By this configuration, the thread formation defines a region comprising about one-half of the skirt portion 16 having an overlapping, double thread profile (i.e., about 180° of the skirt portion), and another region, comprising the other half of the skirt portion, having a single thread profile (i.e., the other 180° of the skirt portion).

During high-speed application of the closure to a container, such as during a bottling operation, the lowermost portion of the thread formation initially engages the mating threads of the container, and thus substantially provides the downward driving force to the closure for application. This initially engaged portion, referred to herein as the leading portion of the thread formation, comprises between about 90° and 180° of the extent of the thread formation. Thus, in the illustrated embodiment, the leading portion of the thread formation generally coincides with that region of the skirt portion having the double thread profile thereon.

Closure 10 is sometimes referred to as being composite in structure, in that it includes a sealing liner 20 positioned adjacent the top wall portion 14 of the closure cap for effecting sealing engagement with the associated container. When the closure is used on a container having a carbonated beverage or the like, it is desirable to release the gas pressure within the container prior to disengagement of the thread formation 18 with the container thread. The provision of axially extending vent grooves 22, which traverse the thread formation 18 and preferably extend into the side wall of the closure, provide flow paths for the release of this gas pressure upon disengagement of the sealing liner 20 with the container finish.

To provide visually discernable evidence that the closure 10 has been partially or completely removed from the associated container, the closure includes a pilfer band 24 which is at least partially detachable connected to the skirt portion 16 of the closure. In the illustrated embodiment, pilfer band 24 comprises an annular band portion 26, inwardly from which extend a plurality of relatively flexible tabs 28, each movable about a respective horizontal axis. Additionally, pilfer band 24 includes an annular interference bead 30 positioned generally beneath the tabs 28.

In accordance with the teachings of U.S. Pat. No. 4,938,370, incorporated herein by reference, this arrangement desirably provides two modes of interfering action with the associated container for tamper-indication. After application to the container, tabs 28 extend generally angularly and upwardly, with the free ends of the tabs generally engaging and abutting the annular locking ring portion of the container. This orientation of the tabs provides the first mode of failure, acting to at least partially detach and separate the pilfer band 24 from the closure skirt portion 16 during removal from a container.

Additionally, the tabs are positionable to extend generally angularly downwardly. In this orientation, the tabs engage and coact with the interference bead 30 to effectively decrease the inside diameter of the pilfer band, thereby again providing the desired interfering engagement with the container locking ring. This provides the second mode of tamper-indication.

In either mode of operation, pilfer band 24 is at least partially detachably connected from the skirt portion 16 by fracture or failure of the frangible connection joining the pilfer band to the skirt portion. This frangible connection is provided by a score line 32 which extends circumferentially of the closure, and which acts to at least partially separate and distinguish the pilfer band and the skirt portion from each other. The frangible connection itself comprises a plurality of circumferentially spaced frangible bridges, herein collectively referred to as frangible bridges 34. As will be further described, in accordance with the present invention, some of the bridges 34 are relatively strengthened to provide preferentially strengthened regions in the frangible connection, which desirably resists premature detachment of the pilfer band from the skirt portion.

Figure 3:
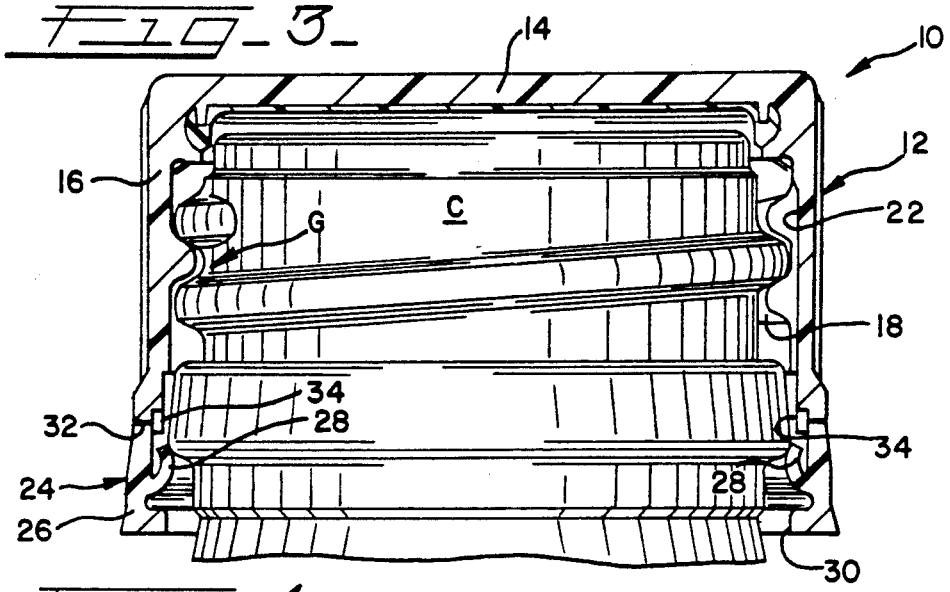
FIGS. 3–5 are cross-sectional views similar to FIG. 1 illustrating the present closure during application to an associated container.
Figure 4:
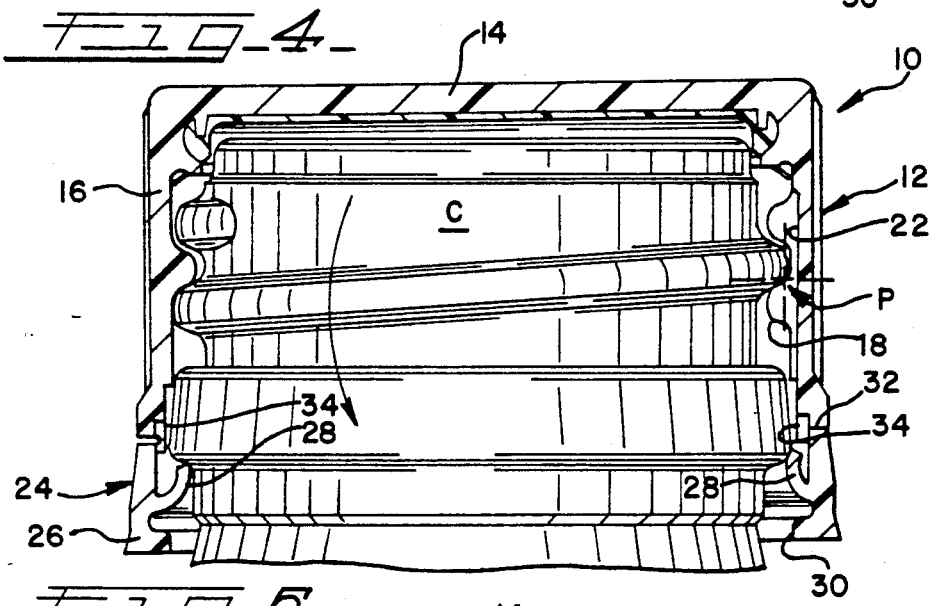
Figure 5:
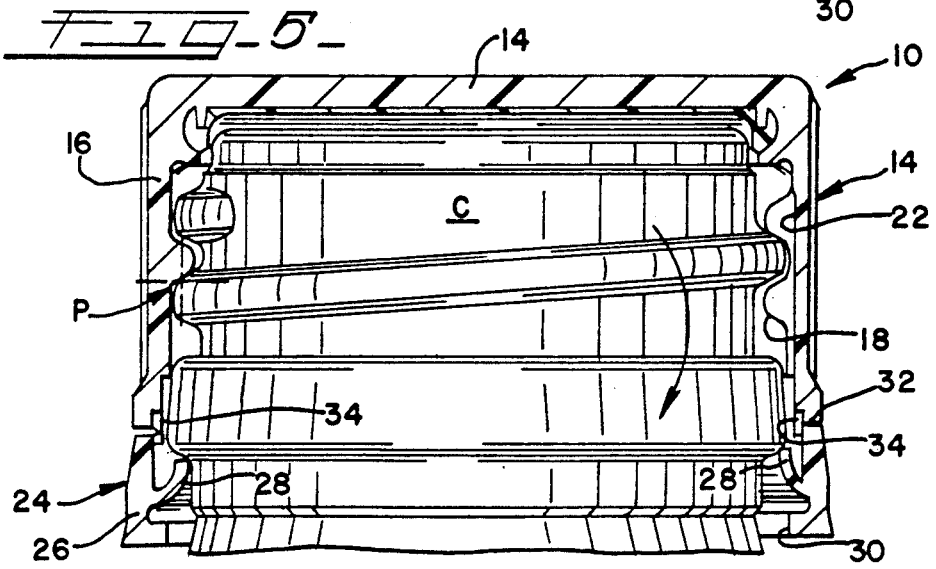

With reference to FIGS. 3–5, the problem of premature detachment is illustrated. Referring first to FIG. 3, it will be noted that the closure 10 has been partially applied to the associated container C, with flexible tabs 28 having been deformed upwardly to an out-of-the-way orientation as they pass by the annular locking ring of the container. As noted, the leading portion of the thread formation 18, which in the illustrated embodiment extends about the double thread profile region of the skirt portion (at the right-hand side of FIG. 3) substantially provides the driving force for urging the closure downwardly into a fully seated position on the container. It should be noted that during this phase of application, a gap exists between the lower surface of the thread formation 18 at the single thread profile region of the closure, as indicated at G.

Referring now to FIG. 4, continued application of the closure is illustrated. Significantly, the upper surface of the leading portion of the thread formation 18 can function in the nature of a pivot, indicated at P, as this portion of the thread drives the closure onto the container. During this phase of application, the generally diametrically opposed portion of the closure thread can exhibit a tendency to be "free floating", that is undergo limited relative vertical movement.

During this phase of application, the tabs 28 begin to slip beneath the container locking ring, with the resilience of the tabs resulting in a snap-like action as they move past the locking ring. As a consequence, and given the gap G which previously existed between the lower side of the thread opposite the leading portion, the closure may undergo limited downward movement of one side relative to the other, as the closure tends to pivot about the pivot point P at the upper surface of the leading thread portion. As the gap G at the lower side of the thread at the other side of the closure is closed, the resultant sudden stopping of the pivoting motion can cause stretching of the internal bridges 34, with the tabs 28 urging the pilfer band downwardly as the tabs move, under their own resilience, to a position beneath the container locking ring.

Summarizing, the action of the tabs 28 against the container locking ring, together with the free floating nature of the portion of the closure opposite the leading thread portion, results in a snap-like action cocking this portion of the closure downwardly, thereby subjecting the frangible bridges 34 at this portion of the closure to localized stress. As will be noted, FIG. 4 illustrates this cocked orientation of the closure, as the side of the closure opposite the leading portion of the thread formation is urged downwardly under the action of the tabs 28.

Referring now to FIG. 5, a secondary reaction can occur a split second later during application, when the flexible tabs at the portion of the closure having the leading thread portion are moved beneath the container locking ring. As this occurs, the closure tends to rotate in a direction generally opposite that which it rotated previously, with a new pivot point P being created generally at the lower surface of the portion of the thread formation opposite the leading portion. This occurs after the first-seated flexible tabs 28 have moved past the container locking ring, with these tabs thus positioned to resist this upward movement as the closure rotates about the new pivot point. Thus, generally the same ones of the frangible bridges 34 which were earlier subjected to localized stress are again subjected to localized stress. As will be appreciated, the frangible bridges at this portion of the closure, which is generally opposed to the leading thread portion, are particularly susceptible to premature fracture as the closure is subjected to this rocking or wobble-like motion during high-speed application.

Figure 2:
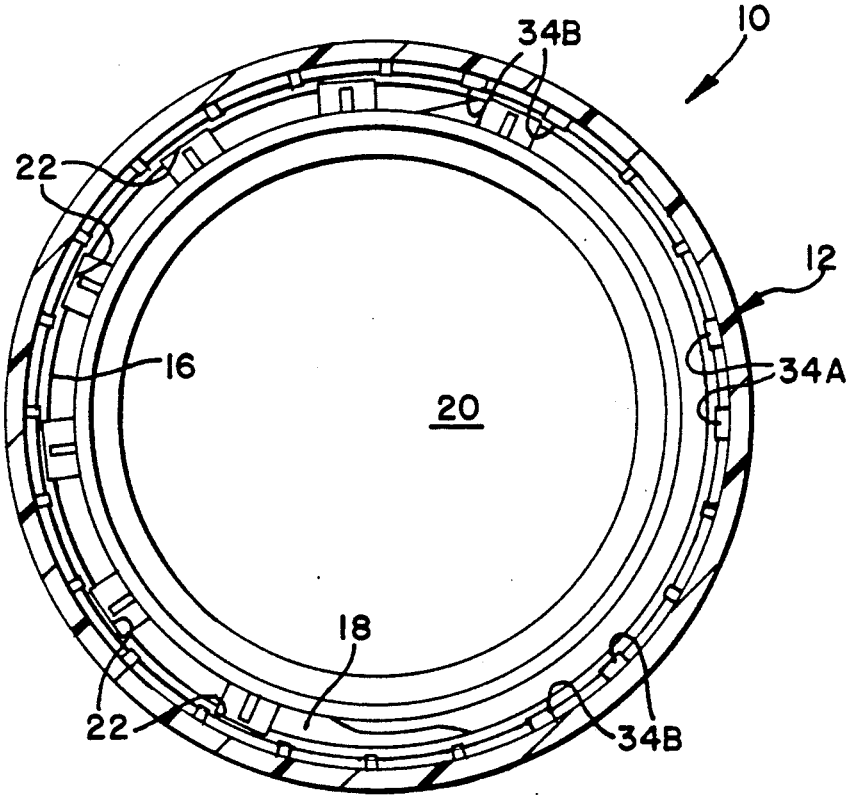
FIG. 2 is a view taken along lines 2—2 of FIG. 1.

Referring now to FIG. 2, the present invention specifically addresses the problems of this localized stressing of the bridges by preferentially strengthening the frangible connection between the pilfer band 24 and the skirt portion 16. This is achieved by providing at least one, and preferably a plurality, of relatively strengthened frangible bridges. In light of the above discussion, it will be appreciated that at least one relatively strengthened frangible bridge is preferably provided in spaced, generally diametrically opposed relation to the leading portion of the thread formation 18. Accordingly, a pair of primary strengthening bridges 34A are provided which are diametrically opposed to the leading portion of the thread formation 18, as defined by the double thread profile region of the closure skirt. Each primary strengthening bridge 34A defines a non-scored residual area having a radial dimension on the order of about 0.015–0.018 inches, and a width of about 0.030 inches. This area is about equal to twice the cross-sectional area of the remaining non-strengthened bridges 34.

Testing has shown that it is further desirable to provide additional relatively strengthened bridges in spaced relation to the primary strengthening bridges 34A. Specifically, two pairs of secondary strengthening bridges 34B are provided in spaced relationship to the primary strengthening bridges 34A. The secondary strengthening bridges are positioned in the region of the frangible connection which also can exhibit a tendency to fracture prematurely, although this premature fracture is generally not as severe as that exhibited in the region of primary strengthening bridges 34A.

In the illustrated embodiment, the secondary strengthening bridges 34B are spaced from the primary strengthening bridges 34A between about 45° and 90° circumferentially of the closure. Additionally, each of the secondary strengthening bridges 34B differs in its cross-sectional area, and thus differs in its strength from each primary strengthening bridge 34A. In a current embodiment, each secondary strengthening bridge 34B has a residual cross-sectional area about equal to 80%–85% of the residual area of each primary strengthening bridge 34A. As will be appreciated, it is within the purview of the present invention to provide one or more strengthening bridges in any number of relative orientations, with a variety of cross-sectional areas.

From the foregoing, it will be observed that numerous modifications and variations can be effected without departing from the true spirit and scope of the novel concept of the present invention. It is not intended that the present invention be limited to the specific embodiment illustrated. The disclosure is intended to cover by the appended claims all such modifications as fall within the scope of the claims.

What is claimed is:

1. A tamper-indicating closure for a container, comprising a plastic closure having a top wall portion, and a depending, annular skirt portion, said skirt portion including an internal thread formation extending more than 360° circumferentially of said skirt portion to thereby define a region of said skirt portion having an overlapping, double thread profile, and a region having a single thread profile;

a tamper-indicating pilfer band positioned beneath said skirt portion, said pilfer band including means for engaging said container for tamper-indication; and preferentially strengthened frangible means at least partially detachably connecting said pilfer band to said skirt, said frangible means comprising a plurality of circumferentially spaced frangible bridges extending between the inside surfaces of said pilfer band and said skirt portion, including at least one relatively strengthened frangible bridge spaced from said region of said skirt portion having said double thread profile.

2. A tamper-indicating closure in accordance with claim 1, wherein said internal thread formation extends about 540° circumferentially of said skirt portion so that said region having said single thread profile comprises about one-half of said skirt portion, and said region having said double thread profile comprises the other half of said skirt portion.

3. A tamper-indicating closure in accordance with claim 1, wherein said frangible means comprises a plurality of relatively strengthened frangible bridges, at least two of said relatively strengthened frangible bridges having differing cross-sectional areas to provide differing strengths.

4. A tamper-evident closure in accordance with claim 3, wherein at least one of said strengthened frangible bridges comprises a primary strengthening and has a first relatively large cross-sectional area, said primary strengthening bridge being generally diametrically opposed to said double thread profile region, at least one of said strengthened frangible bridges comprising a secondary strengthening bridge and having a second cross-sectional area less than said first area, said secondary strengthening bridge being circumferentially spaced from said primary strengthening bridges between about 45° to about 90°.

5. A tamper-indicating closure in accordance with claim 1, wherein said skirt portion and said pilfer band are distinguished from each other by circumferentially extending score line means, said score line means extending partially into said frangible bridges.

6. A tamper-indicating closure in accordance with claim 5, wherein said container engaging means comprises a plurality of circumferentially spaced, inwardly extending flexible tabs engageable with said container for at least partially detaching said pilfer band from said skirt portion.

7. A tamper-indicating closure in accordance with claim 6, wherein each of said flexible tabs is movable about a respective horizontal axis, and positionable to extend angularly upwardly so that a free end thereof engages and abuts said container.

8. A tamper-indicating closure in accordance with claim 7, wherein said pilfer band further includes an annular interference bead positioned generally beneath said flexible tabs, said tabs being positionable to extend angularly downwardly for engagement with said interference bead to effectively decrease the inside diameter of said pilfer band.

9. A tamper-indicating closure for a container, comprising:

a closure cap having a top wall portion, and a depending, annular skirt portion, said skirt portion including an internal thread formation for cooperation with said container, said thread formation including a leading portion which first engages said container during application of said closure thereto;

a tamper-indicating pilfer band positioned beneath said skirt portion, said pilfer band including means for engaging said container for tamper-indication; and preferentially strengthened frangible means at least partially detachably connecting said pilfer band to said skirt portion, said frangible means comprising a plurality of circumferentially spaced frangible bridges, including at least one relatively strengthened frangible bridge circumferentially spaced from said leading portion of said thread formation for resisting premature detachment of said pilfer band said relatively strengthened frangible bridge being generally diametrically opposed to said leading portion of said thread formation.

10. A tamper-indicating closure in accordance with claim 9, wherein said leading portion of said thread formation comprises between about 90°–180° of the extend of said thread formation, said strengthened frangible bridge being generally diametrically opposed to the center of said leading portion of said thread formation.

11. A tamper-indicating closure for a container, comprising:

a closure cap having a top wall portion, and a depending, annular skirt portion, said skirt portion including an internal thread formation for cooperation with said container, said thread formation including a leading portion which first engages said container during application of said closure thereto;

a tamper-indicating pilfer band positioned beneath said skirt portion, said pilfer band including means for engaging said container for tamper-indication; and preferentially strengthened frangible means at least partially detachably connecting said pilfer band to said skirt portion, said frangible means comprising a plurality of circumferentially spaced frangible bridges, including at least one relatively strengthened frangible bridge circumferentially spaced from said leading portion of said thread formation for resisting premature detachment of said pilfer band, said preferentially strengthened frangible means comprising a plurality of relatively strengthened frangible bridges.

12. A tamper-indicating closure in accordance with claim 11, wherein at least two of said relatively strengthened frangible bridges are of differing cross-sectional areas to provide differing strengths.

13. A tamper-indicating closure in accordance with claim 12, wherein at least one of said strengthened frangible bridges comprises a primary strengthening bridge and has a first relatively large cross-sectional area, said primary strengthening bridge being generally diametrically opposed to said leading portion of said thread formation, at least one of said strengthened frangible bridges comprising a secondary strengthening bridge and having a second cross-sectional area less than said first area, said secondary strengthening bridge being circumferentially spaced from said primary strengthening bridge.

14. A tamper-indicating closure for a container, comprising:

a closure cap having a top wall portion, and a depending, annular skirt portion, said skirt portion including an internal thread formation for cooperation with said container, said thread formation including a leading portion which first engages said container during application of said closure thereto;

a tamper-indicating pilfer band positioned beneath said skirt portion, said pilfer band including means for engaging said container for tamper-indication; and preferentially strengthened frangible means at least partially detachably connecting said pilfer band to said skirt portion, said frangible means comprising a plurality of circumferentially spaced frangible bridges, including at least one relatively strengthened frangible bridge circumferentially spaced from said leading portion of said thread formation for resisting premature detachment of said pilfer band, said internal thread formation extending more than 360° circumferentially of said skirt portion to thereby define a region of said skirt portion having an overlapping double thread profile, and a region having a single thread profile, said leading portion of said thread profile extending in the region having the double thread profile.

15. A tamper-indicating closure for a container, comprising:

a closure cap having a top wall portion, and a depending, annular skirt portion, said skirt portion including an internal thread formation for cooperation with said container, said thread formation including a leading portion which first engages said container during application of said closure thereto;

a tamper-indicating pilfer band positioned beneath said skirt portion, said pilfer band including means for engaging said container for tamper-indication; and preferentially strengthened frangible means at least partially detachably connecting said pilfer band to said skirt portion, said frangible means comprising a plurality of circumferentially spaced frangible bridges, including at least one relatively strengthened frangible bridge circumferentially spaced from said leading portion of said thread formation for resisting premature detachment of said pilfer band, during high speed application of said closure to said container, said container engaging means comprising a plurality of circumferentially spaced, inwardly extending flexible tabs engageable with said container for at least partially detaching said pilfer band from said skirt portion, said container engaging means further comprising an annular interference bead positioned generally beneath said flexible tabs.

16. A tamper-indicating closure in accordance with claim 15, including circumferentially extending score line means for at least partially separating said pilfer band from said skirt portion, said score line means extending partially into said frangible bridges.

* * * * *